US005161768A

United States Patent [19]

Sarabin

[11] Patent Number: 5,161,768

[45] Date of Patent: Nov. 10, 1992

[54] CHRISTMAS TREE STAND

[76] Inventor: Gary T. Sarabin, 411 MacArthur Drive, Prince Albert Sask., Canada, S6V-5X5

[21] Appl. No.: 765,256

[22] Filed: Sep. 25, 1991

[51] Int. Cl.[5] ..... F16M 13/00

[52] U.S. Cl. ..... 248/525; 47/40.5; 248/125; 248/188.6; 248/188.7; 248/528

[58] Field of Search ..... 248/523, 525, 528, 529, 248/519, 188.6, 188.7, 188.91, 150, 125; 47/40.5

[56] References Cited

U.S. PATENT DOCUMENTS

| | | | |
|---|---|---|---|
| 1,713,673 | 5/1929 | Nelson . | |
| 2,500,215 | 3/1950 | Swearingen . | |
| 2,671,624 | 3/1954 | Carney | 248/529 X |
| 2,677,518 | 5/1954 | Happy et al. | 248/125 |
| 2,919,877 | 1/1960 | Gallagher | 248/125 |
| 3,417,952 | 12/1968 | Bieschke | 248/188.6 X |
| 3,437,296 | 4/1969 | Hinz . | |
| 3,533,583 | 10/1970 | Azim | 248/125 |
| 3,661,349 | 5/1972 | De Vries . | |
| 3,719,340 | 3/1973 | Norton | 248/529 X |
| 4,307,540 | 12/1981 | Reisner . | |
| 4,381,621 | 5/1983 | Eby . | |
| 4,399,973 | 9/1983 | Spry et al. | 248/529 X |
| 4,744,536 | 5/1988 | Bancalari | 248/188.7 X |
| 5,014,461 | 5/1991 | von Braucke et al. | 248/523 X |
| 5,082,222 | 1/1992 | Hsu | 248/188.6 X |

*Primary Examiner*—Ramon O. Ramirez

*Attorney, Agent, or Firm*—McFadden, Fincham, Marcus & Anissimoff

[57] ABSTRACT

The present invention relates to a collapsible stand adapted to support a Christmas tree. The stand includes a vertical support member having first and second opposed ends and a plurality of supporting legs, each of the legs being pivotally connected proximate one of the ends for pivotal movement between a first storage position and a second supporting position. A plurality of intermediate members are each associated with a supporting leg, each of the intermediate members being pivotally connected at a first point to the vertical support member, and contain means for pivotally connecting each of the intermediate members to a respective supporting leg.

7 Claims, 2 Drawing Sheets

Fig. 2
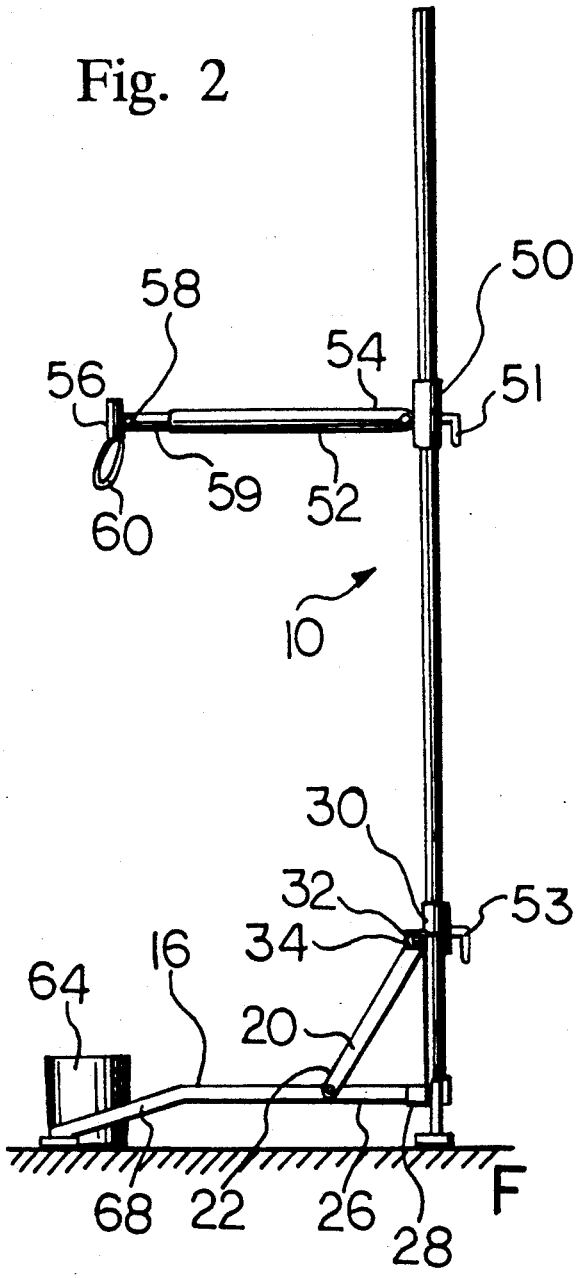
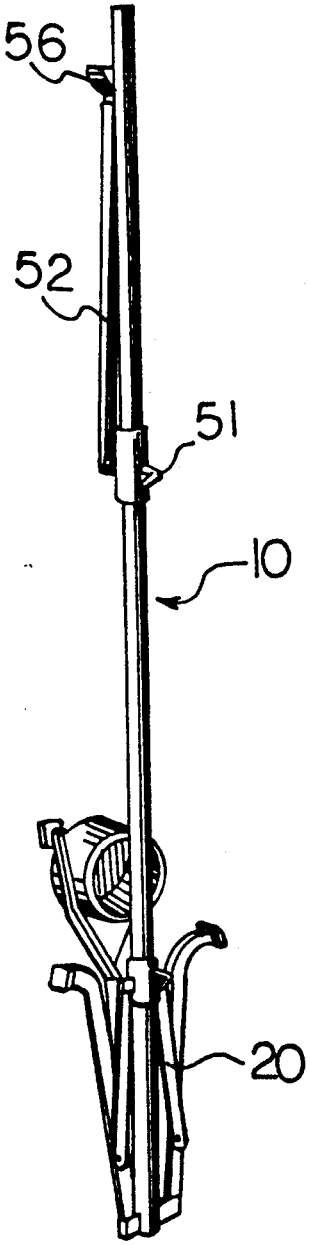
Fig. 3

CHRISTMAS TREE STAND

This invention relates to a support for objects such as Christmas trees.

BACKGROUND OF THE INVENTION

Christmas tree stands have conventionally been awkward to use because of difficulties in obtaining a proper balance with the tree so that it does not tip. They have also normally presented difficulties where the tree trunk was not relatively straight, requiring the services of more than one person to hold and adjust the tree. Many stands are also difficult to work with because of their required proximity to the trunk or because the adjustment must be made at the base of the tree.

It would be desirable to provide a versatile type of stand which firmly engages the tree regardless of the tree's size, bushiness, or the straightness or other characteristics of its trunk, and whereby the stand is conveniently adjustable, easy to use in a variety of locations, and can be stored compactly when not in use.

In the prior art there are numerous examples of tree stands such as U.S. Pat. Nos. 4,399,973; 4,381,621; 4,307,540; 3,661,349; 3,437,296; 2,671,624; and 2,500,215.

In general, these references disclose stands for supporting objects with different characteristics, such as objects which require straightening, etc. In most cases, such stands as will be seen from this art are generally not collapsible for storage purposes. Normally, after use, the stand must be disassembled and then its component parts, stored.

BRIEF SUMMARY OF THE INVENTION

An object of the present invention is to provide a collapsible stand for supporting a Christmas tree, wherein the stand includes a vertical support member having first and second opposed ends, the improvement comprising a plurality of supporting legs, each of the legs being pivotally mounted proximate one of the ends for pivotal movement between a first storage position and a second supporting position; a plurality of intermediate members, each being associated with a supporting leg, each of the intermediate members being pivotally mounted at a first point to the vertical support member; and means for pivotally mounting each of the intermediate members to a respective supporting leg.

Another object of the present invention is to provide a collapsible stand having upper and lower ends, adapted to support an object, the improvement comprising a plurality of supporting legs, each of the legs being pivotally mounted at the lower end of the support member for pivotal movement between a first storage position and a second supporting position; a plurality of intermediate members, each of the intermediate members being slidably connected to the vertical support member; and means for pivotally connecting each of the intermediate members to a supporting leg.

Yet another object of the present invention is to provide a collapsible Christmas tree stand adapted to support a Christmas tree, comprising a vertical support member having first and second opposed ends, the improvement comprising:

a plurality of supporting legs, each of the supporting legs being pivotally mounted proximate one of the ends of the vertical support member for pivotal movement between a first storage position and a second supporting position, the supporting legs comprising first and second portions, the first portion comprising a member adapted to extend laterally relative to the vertical support member, and the second portion being adapted to project downwardly to engage a substrate;

a plurality of intermediate members, each being associated with a supporting leg, each of the intermediate members being pivotally mounted at a first point to the vertical support member;

means for pivotally mounting each of the intermediate members to a respective supporting leg; and lateral engaging means operatively associated with the vertical support member and adapted to releasably engage a Christmas tree trunk, the lateral engaging means being pivotally mounted relative to the vertical support member for pivotal movement between a first storage position and second lateral supporting position.

In greater detail and in explanation of this embodiment of the present invention, the stand is characterized by having supporting legs which can be unfolded from a first storage position to a second supporting position. To this end, the first end of the vertical support member would include mounting means for operatively associating the supporting legs with the vertical support member, whereby the supporting legs would extend from the mounting means or bracket member.

A still further object of the present invention is to provide a structure wherein the supporting legs are elongated legs, one end of which is pivotally associated with the mounting means. Likewise, the intermediate members would also be pivotally mounted at one of their ends to the supporting legs so that each of the supporting legs would fold or unfold between first and second positions.

Still further, the vertical support member is preferably provided with a collar or other means for operatively associating with the other end of the intermediate members for vertical movement along the vertical support member. In place of a collar, other like components can be employed—for example, the vertical support member may be provided with a channel having a member such as a "tee"-shaped member slidable in the channel which would function in the same manner as a collar by permitting relative movement between the collar and the vertical support member.

Suitable means may be provided for fixedly securing the collar or other means to the vertical support member whereby the collar may be releasably engaged and disengaged when desired. To this end, the collar may be provided with one or more apertures, and one or more set screws may be employed. Other locking arrangements of a similar nature can be utilized.

The vertical support member can be of any suitable configuration or material, such as a cylindrical or rectangular steel or plastic column, and for use as a Christmas tree supporting stand, the length of the vertical support member may be variable as desired. Preferably, the vertical support member is a rigid, non-flexible member, which may be hollow for decreasing the weight of the total assembly.

In a like manner, each of the supporting legs and intermediate members may be composed of suitable material such as steel or plastic, and they may also be of a tubular configuration. Preferably, the supporting legs would have first and second portions, with a first portion comprising a member adapted to extend laterally relative to the vertical support member, and a second or end member adapted to project downwardly to engage a substrate, such as a floor. By using such an arrangement, the lower portion of the vertical support member would be spaced from the substrate surface.

The number of legs may vary according to the type of stand desired. For stability, preferably at least three legs are employed, and these may be arranged in geometric patterns. For example, the legs may be triangularly arranged or, in cases where the stand is to be used against a wall, the legs may be slightly spaced apart on one side of the stand. For greater stability, a total of e.g., four or five legs may be employed.

For each leg, an intermediate member is provided which permits the leg to pivotally move between first and second positions. One or more of the legs may be associated with a retaining means for a tree, such as a water cup. Various types of cups or reservoirs may be employed. Preferably, such reservoirs are fixedly secured directly or indirectly to one of the legs, so that the cup or reservoir can likewise be collapsed into a storage position when the legs are similarly collapsed.

For use as a Christmas tree stand for "live" trees, a suitable receptacle may be provided. To this end, the receptacle may be water-impermeable and may be of various sizes and shapes. In a preferred embodiment, one of the legs preferably mounts the receptacle whereby the receptacle may also be folded for storage purposes when the leg is folded.

The stand of this embodiment of the present invention may also include lateral engaging means operatively associated with the vertical support member adapted to releasably engage a tree trunk. The lateral engaging means would also be pivotally mounted relative to the vertical support member for pivotal movement between a first storage position and a second lateral, tree-engaging position.

In a preferred form, this lateral engaging means comprises an arm of rigid material, the arm having, at its free end, means to receive a tree trunk, and which also desirably includes means for engaging the tree trunk and maintaining it in juxtaposition with the means for receiving the tree trunk. Preferred embodiments of this version are where the free end of the lateral arm includes an elastic member and a pair of hooks, whereby the elastic member may be stretched about a tree trunk and engaged at its free end with the hooks.

If desired, the lateral engaging member can be made adjustable by providing one or more extensions, preferably of a telescopic nature.

In making the lateral arm collapsible, one end of the lateral arm may be mounted to a bracket or a mounting member associated with the vertical support member, and pivot means or hinge means may pivotally mount the lateral arm to the bracket.

In a preferred embodiment, the means for receiving the tree trunk comprises an extension associated with one of the supporting legs, the extension having a pair of spaced apart arms, and a container mounted by the arms for receiving the tree trunk.

The apparatus of the present invention has many advantageous features over the prior art. For example, the stand of the present invention may be constructed using three legs, arranged in the form of a "T", in which embodiment, the stand may be positioned against the wall or in a corner so that it is out of the way. The preferred embodiments where set screws are employed to fixedly secure one or more components of the stand relative to the others, permits a structure to be provided which is easily mountable and demountable, merely by loosening the set screws. In addition, a tree which is mounted in the stand of the present invention can be grasped by the telescopic arm at any desired height, since the telescopically mounted arm may be made adjustable on the vertical supporting member. This telescopic arm can also be used to straighten a tree if the tree leans in one direction or another, merely by loosening the set screw and moving the arm in a desired direction to maintain the tree in a straight, upright position.

The stand of the present invention is readily collapsible for storage purposes. The means for pivotally mounting each of the intermediate members to a supporting leg permits the legs to be retracted into a compact, closed position for storage, and also permits their ready re-opening and the assembly of the stand in order to receive a tree.

When utilizing the stand to mount a tree where the stand is positioned behind a tree, as in a corner or against a flat wall, the stand may be hidden from view by the tree branches and also, the lower branches that are relatively close to the floor level may remain on the tree trunk, since there are no components of the stand which would require the removal of such branches.

Still further, in preferred embodiments, the tree trunk may be mounted in the means for receiving the tree trunk, and the upper telescopic arm, when attached to the tree, holds the tree securely in the stand in a very stable manner. No strings or other means for supporting the tree are required, which other stands commonly require. The stand of the present invention does not require any tools for assembly or for collapsing it for storage, and very little time is needed to assemble the stand and to erect a tree therein.

Having thus generally described the invention, reference will now be made to the accompanying drawings.

BRIEF DESCRIPTION OF THE DRAWINGS

FIG. 2 is a side elevational view of the stand of FIG. 1; and

. FIG. 3 is a perspective view of the stand of FIG. 1 in a collapsed position.

DETAILED DESCRIPTION OF THE INVENTION

Figure 1:
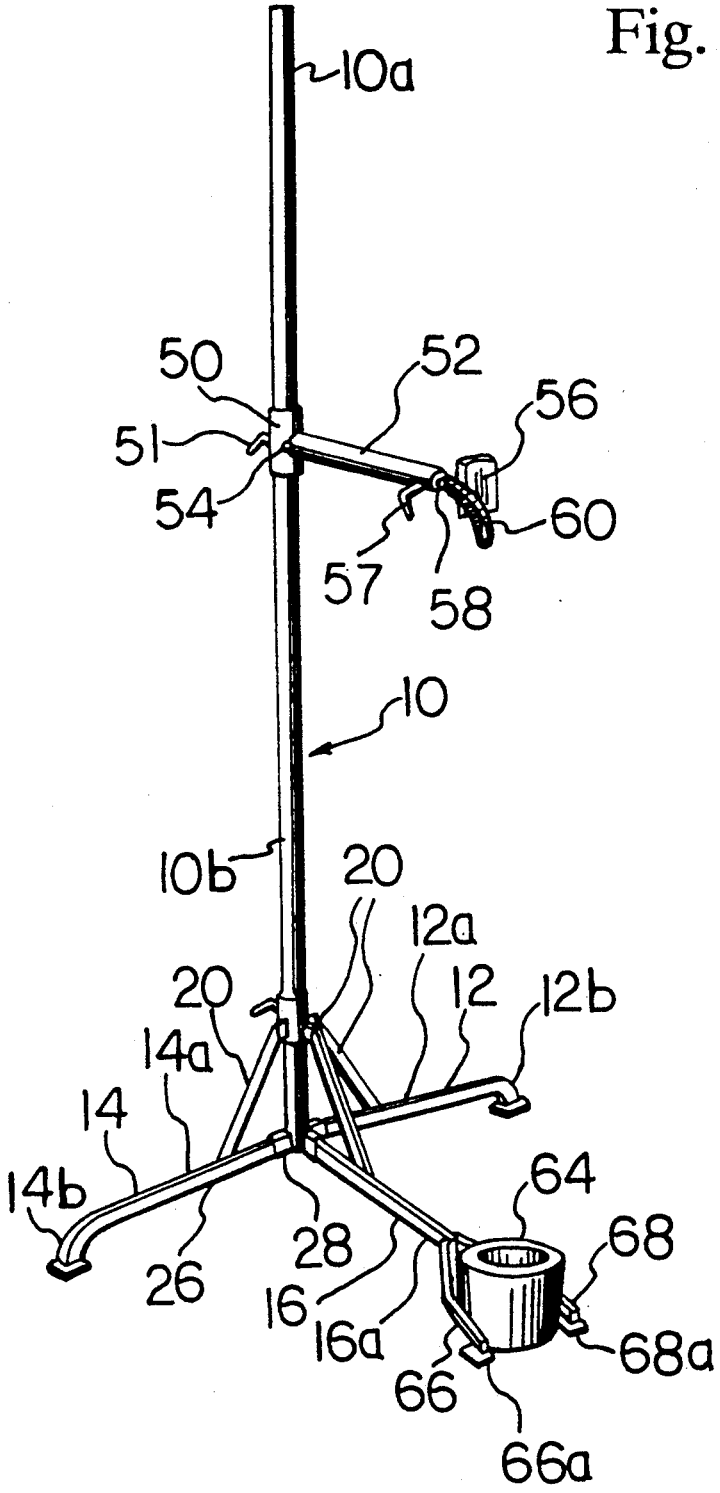
FIG. 1 is a perspective view of a stand of one embodiment of the present invention.

Referring to the drawings, a vertical support stand 10, made of tubular, rigid material such as steel or a plastic extrusion, is shown in association with three spaced apart supporting legs 12, 14 and 16. Stand 10 includes an upper end 10*a* and a lower end 10*b*. In the arrangement illustrated, legs 12 and 14 are on one axially extending line while leg 16 is located at approximately right-angles to the axially extending line between legs 12 and 14. By virtue of this arrangement, the stand may be placed adjacent a wall and thus reduce the amount of space normally required for various types of stands in the prior art. It will be understood, however, that the stand in accordance with one embodiment of the invention and illustrated in FIGS. 1 through 3, may also be provided with a fourth leg which would form a cross-like configuration, if desired.

Each of the supporting legs 12, 14 and 16 includes a first portion 12*a*, 14*a* and 16*a*, each of which is adapted to lie generally in a plane parallel to a floor or substrate F. Supporting legs 12 and 14 have a second portion 12*b* and 14*b*, respectively, each of which lies in a generally right-angle relationship to the corresponding, respective first portions 12*a* and 14*a*. Members 12*b* and 14*b* are adapted to engage the floor surface F and to space the legs and the bottom 10*b* of the vertical stand 10 from the floor.

Each of the legs 12, 14 and 16 is provided with pivotal means for pivotally mounting the legs between a first position in which the stand is as shown in FIG. 1, and a second position in which the legs are fully collapsed and the assembly is ready for storage (FIG. 3). To this end, intermediate members 20 are provided, and are associated with each of the corresponding legs. One end of the intermediate member is pivotally mounted to a leg by pivot 22, which permits the leg and the intermediate member to rotate relative to each other. As will be seen from the drawings, the intermediate member 20 is pivotally associated with a respective leg at a point approximately intermediate the ends of the portions 12*a*, 14*a* and 16*a*.

In a like manner, the ends 26 of each leg are hingedly or pivotally mounted to a bracket 28 fixedly secured to the lower end 10*b* of the vertical stand 10, so that the legs 12, 14 and 16 may pivot between first and second positions. Although a bracket has been shown for pivotally mounting the ends of the legs, it will be understood that the leg ends 26 may also be fixedly secured to the stand 10 directly.

In the preferred embodiment shown in the drawings, a collar 30 is slidably journaled on the stand 10 proximate the lower end 10*b*. The collar mounts one end of each intermediate member 20 in a pivotal manner by a corresponding pivot 32. Pivots 32 may be mounted by a bracket 34 associated with the collar for the corresponding ends of each of the intermediate members.

The collar 30 may be fixedly secured to the vertical support member 10 by providing an aperture extending through the collar and by a set screw 53 to secure the collar to the support member 10. In this manner, when it is desired to retain the collar and consequently the legs in one or the other position, the set screw may be loosened or tightened as required to releasably disengage the collar from the vertical support member.

As illustrated in the drawings, the stand of this embodiment of the present invention also includes an upper tree-engaging member. To this end, a bracket 50 may be fixedly secured to the vertical support member 10 by set screw 51, and one end of a sleeve member 52 may be pivotally or hingedly fixed to the bracket 50 by means of a pivot pin 54. At the opposed end of the sleeve member 52, there is provided a "V"-shaped bracket 56 fixedly secured to a telescoping arm 59, the latter being slidable inwardly and outwardly of sleeve member 52. The bracket 56 may be mounted in a rotatable and laterally adjustable manner on arm 59. A set screw 57 may be used for securing the telescopic arm 59 to the sleeve member 52 in its desired position of extension or retraction from the sleeve. Also, the arm mounts a pair of hook members 58 spaced inwardly from the free end of the arm. An elastic band member 60 has one of its ends connected to the bracket 56, and the other end is adapted to extend about a tree trunk (not shown) and then to engage with hook members 58. By using the telescopic arm, and by virtue of the fact that the bracket 50 is adjustably mounted on the support member 10, the tree may be gripped at different vertical levels depending on the size of the tree, and the tree may also be gripped at a point where there is a space or gap between adjacent branches.

In addition, the elastic member 60 can serve to retain the member 52 against the vertical support member 10 for storage purposes.

In the embodiment shown, the stand includes a cup or tree trunk retaining member 64 associated with one of the legs, e.g. leg 16. Leg 16, in the example, is provided with a pair of diverging arms 66 and 68, which mount the cup 64 therebetween in a fixed manner. Cup 64 may be used to contain Water, or may serve only as a retaining means for the tree trunk. The cup 64 may also include a spike or similar arrangement adapted to engage with the bottom of the tree to retain the tree in position within the cup. It will be noted that arms 66 and 68 not only diverge outwardly, but also downwardly to form a pair of feet 66*a* and 68*a*, respectively, thus providing a further support for the leg 16. Alternatively, arms 66 and 68 may releasably embrace a larger version of cup 64 and the cup 64 functions as a support in the absence of feet 66*a* and 68*a*.

After use of the stand, the legs 12, 14 and 16 may be pivoted into a storage position against the vertical support member 10 by releasing the set screw 53 in the collar 30, which would thus permit the collar to slide upwardly on the vertical support member 10 by pivoting action of the legs upwardly and inwardly towards the support member 10, which basically creates a folding or retracting action. Similarly, the sleeve member 52 may be folded, with the resulting structure being that shown in FIG. 3 of the drawings.

It will be understood that various modifications can be made to the above-described embodiments without departing from the spirit and scope of the invention.

I claim:

1. A collapsible tree stand comprising:

a support member having top and bottom ends;

a plurality of legs extending radially from said support member and having inner and outer ends, each leg pivotally attached at an inner end to the bottom end of said support member;

a plurality of intermediate members, one for each leg, each intermediate member individually pivotally attached at a lower end to a leg at a position intermediate the ends of the leg;

a collar slidably mounted on said support member at a lower portion and including collar locking means for locking said collar at alternate selected positions on the support member, each intermediate member pivotally attached at an upper end to said collar;

a bracket slidable on said support member above said collar and including bracket locking means for locking said bracket at variable selected position on the support member;

a support arm pivotally attached at an inner end to said bracket and including a releasable tree trunk holding means at an outer end;

the arrangement such that on release of said collar locking means, said collar can be slid up said support member and said legs pivot upwards to lie along side said support member.

2. A stand as defined in claim 1, wherein said support arm comprises a telescopically adjustable member.

3. A stand as defined in claim 1, to of said legs extending laterally, one on each side of said support member, in a substantially common plane, and a third leg extending forward substantially normal to said two legs.

4. A stand as defined in claim 3, including means for positioning and supporting a base of a tree trunk, said means mounted on said third leg.

5. A stand as defined in claim 1, including means for receiving a base of a Christmas tree trunk, said means being associated with at least one of said legs.

6. A stand as defined in claim 5, wherein said means for receiving a base of a Christmas tree trunk comprises an extension on one of said legs, said extension having a pair of spaced apart arms and a container mounted by said arms for receiving said base of a Christmas tree trunk.

7. A stand as defined in claim 3, said means for positioning and supporting a tree base comprising a container, and means pivotally mounting said container on said third leg.

* * * * *